United States Patent [19]

Rakow et al.

[11] 4,068,330

[45] Jan. 17, 1978

[54] WOVEN SPRING UNIT

[75] Inventors: Wallace J. Rakow; Elmer J. Millette, both of Sheboygan, Wis.; Peter J. Johnston, Conyngham, Pa.

[73] Assignee: Spiller Spring Company, Sheboygan, Wis.

[21] Appl. No.: 659,942

[22] Filed: Feb. 20, 1976

[51] Int. Cl.[2] ..... A47C 23/02

[52] U.S. Cl. ..... 5/267; 5/257

[58] Field of Search ..... 5/248, 256, 265, 267, 5/273, 277

[56] References Cited

U.S. PATENT DOCUMENTS

| | | | |
|---|---|---|---|
| 3,270,354 | 9/1966 | Campa et al. | 5/275 |
| 3,774,248 | 11/1973 | Huras | 5/267 |
| 3,789,440 | 2/1974 | Garceau | 5/267 |
| 3,864,765 | 2/1975 | Anonauer | 5/267 |
| 3,953,903 | 5/1976 | Lawrence et al. | 5/267 |

*Primary Examiner*—Casmir A. Nunberg

*Attorney, Agent, or Firm*—Merriam, Marshall & Bicknell

[57] ABSTRACT

A rigid spring unit is constructed of coil springs and a top grid comprising a plurality of wires, including a first group or pair of parallel wires spaced apart a distance less than the diameter of the top coil of each spring. A second group of three wires, at right angles to the first pair, includes a pair of outside wires spaced apart a distance less than the diameter of the top coil of the spring and a locking wire intermediate the outside wires. The top coil of each spring includes indentations that permit the top coil to be seated from below, in a pre-stressed, woven fashion into the wires of the top grid.

7 Claims, 4 Drawing Figures

WOVEN SPRING UNIT

BACKGROUND OF THE INVENTION

1. Field of the Invention

This invention pertains to spring units and in particular to a unitized spring structure of coil springs attached to a wire grid.

2. Description of the Prior Art

Prior spring units have generally been divided into essentially two categories. A first category includes a wire top grid having intricate wire bends forming locking members which are used to positively secure and enclose or capture the top coil of a spring such as illustrated in U.S. Pat. No. 3,577,574. The intricate bend arrangement generally requires the use of special assembly tools in attaching the top coil to the wire grid.

A second type of spring unit is illustrated in U.S. Pat. No. 3,864,765 which discloses a bedspring structure having a top grid with transversely extending wire pairs attached above longitudinally extending wires. The top coil of each bedspring is then placed above the lower wire but below the upper wire of the grid work and thus positioned in the grid. The top wires, that is the transversely extending wires of the grid, include indentations or offsets that nest into the top coil and frictionally retain each spring in position.

In addition to the problem mentioned above in connection with the first category, both categories of spring units present other problems by requiring complicated bends and indentations in the top grid wires which induce into the thin wires critical stresses that can cause premature failure. Secondly, because the grid wires have been deformed, the orientation, spacing and alignment of the wires, prior to welding and insertion of the coil spring, requires precise, time consuming positioning in both transverse and longitudinal directions.

SUMMARY

This invention pertains to a unitized spring structure wherein a top grid composed of a plurality of intersecting wires provides a means for mounting resilient coil springs without the use of auxiliary fasteners, welds or deformation of the grid wires to engage the coil springs. The wires of the top grid are arranged in first groups of wire pairs extending in one direction and are arranged in second groups of three wires extending in a second direction at right angles to the first pairs of wires. All the wires in both groups are straight and undeformed.

The three wires of the second group in the top grid include a pair of outside wires spaced apart a distance corresponding to the spacing between the pairs of wires in the first group. Additionally, there is a central or locking wire between the outside wires of the second group which serves as a biasing and locking wire for attachment of the spring top coil. Each coil spring includes an enclosed, circular top coil that has a plurality of spaced indentations for use in attaching the spring to the top coil. Two of the spaced indentations are positioned over the associated outside wires of the second group to overlap the outside wires in a radially outward direction and two indentations are positioned under the locking wire, to form a woven connection between the spring top coil and the top grid.

Thus, the invention disclosed herein provides an improved attaching arrangement wherein a simplified, low cost top grid is easily manufactured because of the absence of indentations, crimps, locking configurations or other deformations in the grid wires. Because there are no deformations in the grid wires, assembly and welding of the top grid and attachment of the coil springs is simplified.

These and other features of the spring unit disclosed herein will become apparent with reference to the following description, drawings and claims.

DETAILED DESCRIPTION

Figure 1:
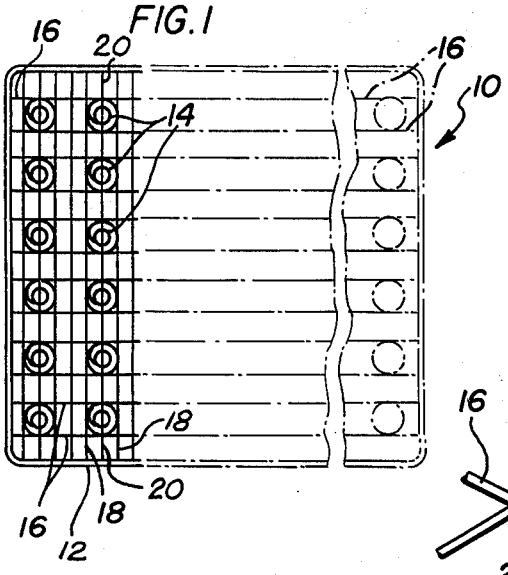
FIG. 1 is a top plan view, with portions in phantom, of a top grid and coil spring unit in accordance with an embodiment of the present invention.
Figure 2:
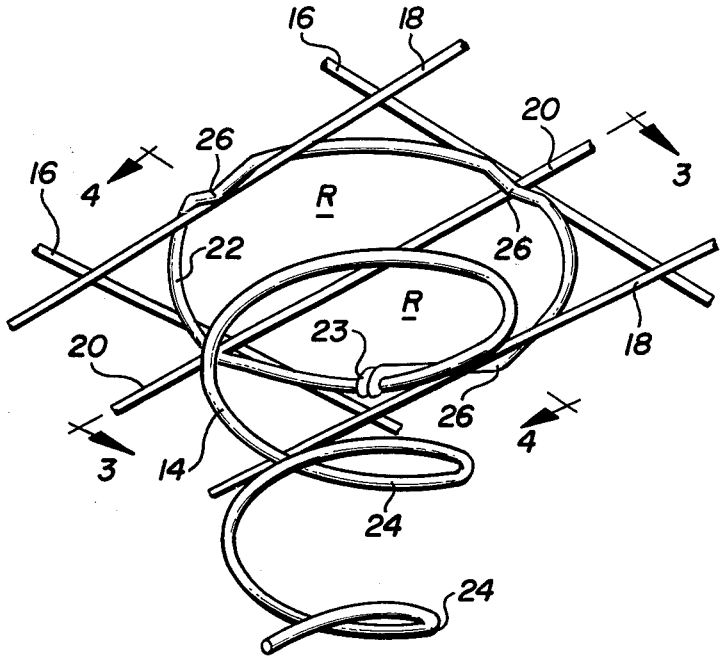
FIG. 2 is a perspective view of the coil spring and grid as viewed from below the top grid.

Referring now to the drawings and in particular to FIG. 1, there is shown a spring unit 10 such as that used in a box spring. Spring unit 10 includes a top grid 12 constructed with a plurality of intersecting wires welded together and attached to a plurality of coil springs 14 having generally circular top coils 22 (FIG. 2). Pairs of straight undeformed first wires 16 extend in one direction and intersect and are attached to second groups of straight undeformed wires which extend at right angles to the first wires 16. Each of the second groups of wires includes a pair of outside wires 18 and an intermediate locking wire 20. First wires 16 and outside wires 18 form a number of square coil support seats having a length/width dimension slightly less than the diameter of the spring top coil 22. Locking wires 20 are positioned between the outside wires 18 and extend parallel therewith to form rectangles R (FIG. 2).

Each coil spring 14 may include a generally tapered helical configuration and has a top coil 22 defining a closed circle terminating at a crimped end 23. A number of lower coils 24 spiral downwardly from the top coil and terminate at a lower member (not shown) which is stapled or otherwise fastened to a support frame.

Figure 4:
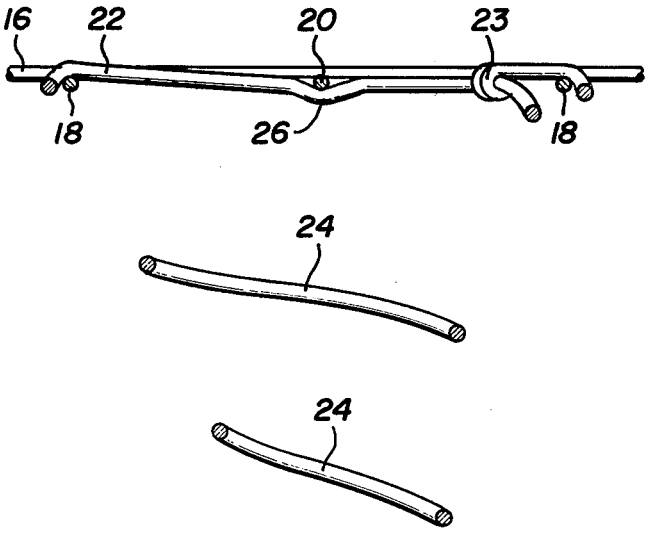

Spring top coil 22 has indentations 26 formed therein for purposes of holding the spring securely to top grid 12. These indentations 26 may have a slight V-shaped or other convenient contour and should be of sufficient depth to extend over the associated outside wire 18, overlapping the latter in a radially outward direction, to securely hold the spring in position. As shown in FIGS. 2 4, each indentation 26 has sloped sides that converge to an apex or terminal portion which should extend below the attached outside wire 18.

The top grid 12 may be easily assembled of low cost, low carbon steel, common wire material, because there are no indentations, crimps or other deformations therein that would require the use of a more expensive, high carbon steel or alloy steel material. Furthermore, because there are no indentations in the wires of the top grid, there is no requirement that the top grid wires 16, 18, 20 be precisely oriented with respect to one another during assembly.

Figure 3:
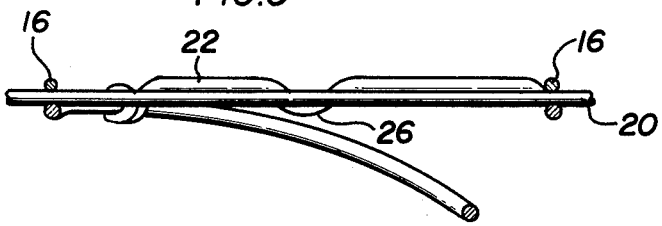
FIG. 3 is a sectional view taken generally along lines 3—3 of FIG. 2; and, FIG. 4 is a sectional view taken generally along lines 4—4 of FIG. 2.

As shown in FIG. 2, the top coil 22 of each coil spring 14 is attached in a woven fashion between the wires of the top grid and securely held in place by frictional and pre-stressed locking engagement between the portions of top coil 22 and the top grid wires 16, 18 and 20. In assembling the coil spring 14 to the top grid 12, the indentation 26 at the lower righthand portion of FIG. 2 is fitted up and over the adjacent outside wire 18. Thereafter, the indentation 26 at the upper lefthand portion of FIG. 2 is fitted over the adjacent outside wire 18. In this position top coil 22 overlaps the outside wires 18 and underlaps the locking wire 20, thus producing a biased, woven contour to the spring top coil 22, as shown in FIGS. 2–4. This biasing flexes the top coil 22 into a pre-stressed, secure engagement with the top grid in such a fashion as to produce a high frictional locking force. Further, each indentation 26 that overlaps a wire 18, serves to hold the top coil 22 firmly in position. The other indentations 26 that are below the locking wires 20 also hold the top coil in position by nesting below and receiving the locking wires 20. As shown in the drawing, the top coil indentations 26, 26 which underlap and receive a locking wire 20 do so at a pair of locations on wire 20 adjacent the intersections of wire 20 with wires 16, 16 of the first pair of wires. Thus, those indentations 26 which are below locking wires 20, and locking wires 20, cooperate to hold overlapping indentations 26 in overlapping engagement with outside wires 18.

The method of manufacturing the spring unit 10 includes arranging first wires 16 in parallel and spaced apart a distance slightly less than the diameter of the spring top coil 22. For example, when using a coil spring with a top coil diameter of 4.125 inches (10.47 cm.), spacing of these wires may be approximately 4 inches (10.16 cm.). Outside wires 18 are then positioned on top of wires 16 and are also spaced apart a distance slightly less than the diameter of the spring top coil, that is, 4 inches (10.16 cm.). Also, locking wires 20 are disposed centrally of outside wires 18 to form a pair of small rectangles R having a length twice as long as the width. All the top grid wires are then fastened together, as by welding, to form a single unit with wires 16 in one plane and wires 18, 20 extending in a second plane. Because the grid wires extend in a planar fashion, without crimps or deformations for attaching spring coils, a rigid, dimensionally secure top grid 12 is produced.

After the top grid 12 is assembled and ready for attachment of the coil springs 14, the center of each coil spring 14 is placed in a position offset from the associated locking wire 20 and one indentation 26 of top coil 22 is placed over one of the outside wires 18. The oppositely spaced indentation 26 is then lifted above the other outside wire 18 and the entire top coil is then moved horizontally until the center of each coil spring 14 aligns with its associated locking wire 20. Finally, the oppositely spaced indentation 26 is released to overlap and engage the associated outside wire 18. The top coil may be attached, as described above, without the use of any special assembly tools or machinery. As shown in the drawing, the totality of the connection between top grid 12 and top coils 22 is the engagement of outside wires 18 by overlapping indentations 26 and the reception of locking wires 20 by those indentations 26 below the locking wires.

The foregoing description and drawings merely explain and illustrate the invention and the invention is not limited thereto, except insofar as the appended claims are so limited, as those who are skilled in the art who have the disclosure before them will be able to make modifications and variations therein without departing from the scope of the invention.

What is claimed is:

1. A spring unit comprising:

coil spring means having a generally circular top coil and lower coils;

a top grid portion having a first group or straight, undeformed wires and having a second group of straight, undeformed wires extending transversely to said first group;

said first group of wires comprising a pair of straight, undeformed wire members;

said second group of wires including straight, undeformed outside wire members spaced apart and including a straight, undeformed locking wire member located between said outside wire members and intersecting each of said wire members in said first group of wires;

said top coil including means for overlapping in a radially outward direction and engaging said outside wire members of said second group of wires;

said top coil also including means for underlapping and receiving said locking wire member at a pair of locations each adjacent the intersection of said locking wire member and a respective wire member of said first group of wires; and, means, including said overlapping means on said top coil, for biasing the top coil into woven attachment with the top grid portion;

said underlapping means on the top coil and said locking wire members compising means cooperating to hold said overlapping means in engagement with said outside wires members.

2. The spring unit of claim 1, wherein said means on the top coil for engaging said wire members comprises:

indentations in said top coil, said indentations including a terminal portion and sloped portions extending outwardly and upwardly therefrom.

3. A spring unit comprising:

a top grid having first pairs of straight, undeformed wires extending in a first direction and second pairs of straight, undeformed wires extending in a transverse direction to the first pairs;

means joining said pairs of wires at their points of intersection and providing a plurality of undeformed coil supports;

straight, undeformed locking wires positioned between each of said second pairs of wires and dividing said coil supports into a plurality of rectangles;

each of said locking wires intersecting both wires in a respective one of said first pair of wires; and coil springs having circular top coils ;

said coil springs being arranged in rows extending at right angles to each other;

said circular top coils each having engaging means comprising (a) one set of indentations for overlapping in a radially outward direction and engaging the second pair of wires of a coil support and (b) another set of indentations for underlapping and receiving said locking wire of said coil support at a pair of locations on said locking wire each adjacent the intersection of the locking wire and a respective wire in the corresponding first pair of wires, to bias said top coil into woven attachment with said top grid;

said underlapping set of indentations on the top coil and said locking wire comprising means cooperating to hold said overlapping set of indentations in engagement with said second pair of wires.

4. The spring unit of claim 3, wherein said indentations have a generally V-shaped contour with sides sloping downwardly from the top coil and terminating at a terminal end.

5. The spring unit of claim 4, wherein said indentations extend downwardly a distance greater than the thickness of the wires of said second pair of wires of the top grid.

6. A spring unit as recited in claim 1 wherein the totality of the connection between said top grid portion and said top coil is (1) the engagement of said outside wire members by said overlapping means on the top coil and (2) the reception of said locking wire member by said underlapping means on the top coil.

7. A spring unit as recited in claim 3 wherein the totality of the connection between said top grid and said circular top coils is (1) the engagement of said second pairs of wires by said one set of indentations on the top coils and (2) the reception of said locking wires by said other set of indentations on the top coils.

* * * * *